US011480898B2

(12) United States Patent
Kodera et al.

(10) Patent No.: US 11,480,898 B2
(45) Date of Patent: Oct. 25, 2022

(54) TRANSPORT DEVICE AND IMAGE FORMING APPARATUS

(71) Applicant: FUJIFILM Business Innovation Corp., Tokyo (JP)

(72) Inventors: Tetsuro Kodera, Kanagawa (JP); Kosuke Yamada, Kanagawa (JP); Nobuyuki Nakayama, Kanagawa (JP); Takayuki Yamashita, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/324,078

(22) Filed: May 18, 2021

(65) Prior Publication Data

US 2022/0035279 A1 Feb. 3, 2022

(30) Foreign Application Priority Data

Jul. 30, 2020 (JP) ..... JP2020-129352

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
See application file for complete search history.

(56) References Cited

U.S. PATENT DOCUMENTS

2005/0236762 A1 10/2005 Hayasaka et al.
2020/0218181 A1* 7/2020 Midorikawa ..... G03G 15/2021

FOREIGN PATENT DOCUMENTS

| | | | |
|---|---|---|---|
| JP | 2004075301 | | 3/2004 |
| JP | 2004075301 A | * | 3/2004 |
| JP | 2011-039148 | | 2/2011 |
| JP | 2011039148 A | * | 2/2011 |
| JP | 2011051131 | | 3/2011 |
| JP | 2012154981 | | 8/2012 |

OTHER PUBLICATIONS

JP_2004075301_A_T MachineTranslation, Japan, 2004, Nishizawa.*
JP_2011039148_A_T MachineTranslation, Japan, 2011, Kamoda.*
"Search Report of Europe Counterpart Application", dated Nov. 23, 2021, p. 1-p. 10.

* cited by examiner

*Primary Examiner* — Victor Verbitsky
(74) *Attorney, Agent, or Firm* — JCIPRNET

(57) ABSTRACT

A transport device includes a transport unit that transports a sheet-like transport material without holding a one-end-side portion of the transport material in a transport direction; and a blowing unit that blows air against a lower surface of the transport material that is transported by the transport unit via multiple blowing holes that open with respect to the lower surface, an arrangement interval of the multiple blowing holes in the transport direction being inconstant in the transport direction.

3 Claims, 10 Drawing Sheets

TRANSPORT DEVICE AND IMAGE FORMING APPARATUS

CROSS-REFERENCE TO RELATED APPLICATIONS

This application is based on and claims priority under 35 USC 119 from Japanese Patent Application No. 2020-129352 filed Jul. 30, 2020.

BACKGROUND

(i) Technical Field

The present disclosure relates to a transport device and an image forming apparatus.

(ii) Related Art

Japanese Unexamined Patent Application Publication No. 2011-39148 discloses a fixing device that includes a non-contact transporter that holds and transports a transport-direction leading end of a cut sheet having an unfixed image thereon so that a transport member does not contact two surfaces of the cut sheet, and a non-contact heater that heats in a non-contact manner the cut sheet that is being transported by the non-contact transporter. This fixing device includes a gas blower that blows gas against a front surface and a back surface of the cut sheet that is in a heated state due to the non-contact heater.

SUMMARY

A transport device includes a transport unit that transports a sheet-like transport material without holding a one-end-side portion of the transport material in a transport direction and a blowing unit that blows air against a lower surface of the transport material that is transported by the transport unit through multiple blowing holes that open with respect to the lower surface. In this transport device, when the multiple blowing holes only include blowing holes that are disposed at a constant interval in the transport direction, the one-end-side portion of the transport material in the transport direction may resonate.

Aspects of non-limiting embodiments of the present disclosure relate to, when compared with the structure in which the multiple blowing holes only include blowing holes that are disposed at a constant interval in the transport direction, a reduction in resonance of a one-end-side portion of a transport material in the transport direction.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a transport device including a transport unit that transports a sheet-like transport material without holding a one-end-side portion of the transport material in a transport direction; and a blowing unit that blows air against a lower surface of the transport material that is transported by the transport unit via multiple blowing holes that open with respect to the lower surface, an arrangement interval of the multiple blowing holes in the transport direction being inconstant in the transport direction.

BRIEF DESCRIPTION OF THE DRAWINGS

Exemplary embodiments of the present disclosure will be described in detail based on the following figures, wherein.

DETAILED DESCRIPTION

Examples of exemplary embodiments of the disclosure are described below based on the drawings. Note that arrow H shown in a corresponding one of the figures indicates a vertical direction and an apparatus up-down direction, arrow W indicates a horizontal direction and an apparatus width direction, and arrow D indicates an apparatus front-back direction (an apparatus far-side direction).

First Exemplary Embodiment

Image Forming Apparatus 10

Figure 1:
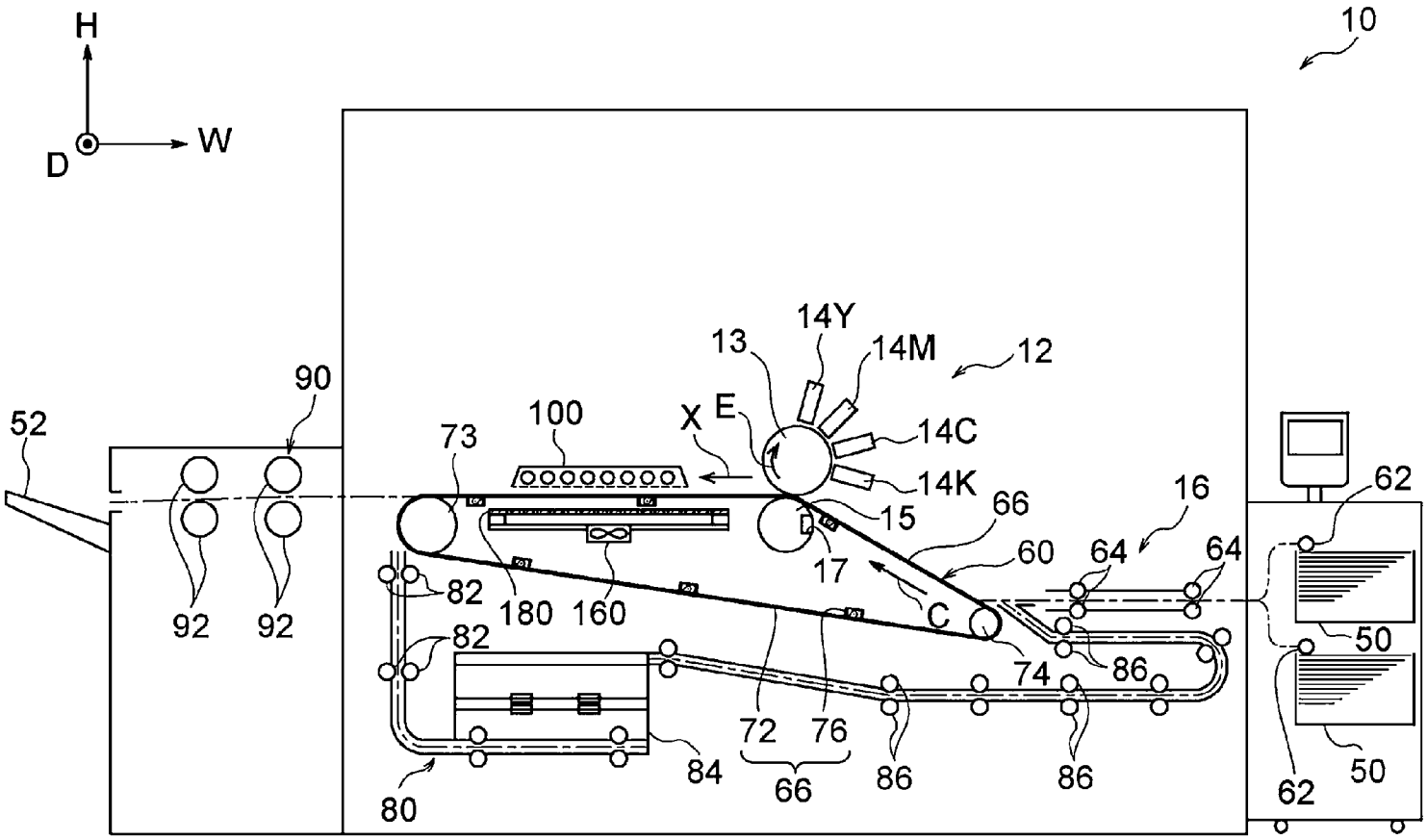
FIG. 1 is a schematic view of a structure of an image forming apparatus according to a first exemplary embodiment.

A structure of an image forming apparatus 10 according to an exemplary embodiment is described. FIG. 1 is a schematic view of a structure of the image forming apparatus 10 according to an exemplary embodiment.

The image forming apparatus 10 shown in FIG. 1 is an image forming apparatus that forms an image on a recording medium serving as an example of a sheet-like transport material. Specifically, the image forming apparatus 10 is an inkjet image forming apparatus that forms an image on a sheet P, serving as an example of the recording medium, by using ink. More specifically, as shown in FIG. 1, the image forming apparatus 10 includes accommodation units 50, a discharge unit 52, an image forming unit 12, a heating device 100, a cooling unit 90, and a transport device 16. Each portion (the accommodation units 50, the discharge unit 52, the image forming unit 12, the heating device 100, the cooling unit 90, and the transport device 16) of the image forming apparatus 10 is described below.

Accommodation Units 50

Each accommodation unit 50 shown in FIG. 1 has the function of accommodating sheets P. The image forming apparatus 10 includes, for example, two accommodation units 50. Sheets P are selectively sent out from the multiple accommodation units 50. As sheets P, for example, the so-called cut sheets having a predetermined size are used.

Discharge Unit 52

The discharge unit 52 shown in FIG. 1 is a portion to which a sheet P having an image formed thereon is discharged. In the image forming apparatus 10, after the image has been heated by the heating device 100, the sheet P that has been cooled by the cooling unit 90 is discharged to the discharge unit 52.

Image Forming Unit 12

The image forming unit 12 shown in FIG. 1 is an example of an image forming unit that forms an image on a recording medium. Specifically, the image forming unit 12 forms an image on a sheet P by using ink. More specifically, as shown in FIG. 1, the image forming unit 12 includes ejection units 14Y, 14M, 14C, and 14K (hereunder referred to as "14Y to 14K") that eject ink. The image forming unit 12 also includes a transfer drum 13 and an opposing roller 15.

The transfer drum 13 is provided above a transport path of a sheet P that is transported by the transport device 16, and is disposed at a position allowing the transfer drum 13 to contact an upwardly facing surface (hereunder referred to as "upper surface") of the sheet P. The transfer drum 13 is rotationally driven in a direction E in FIG. 1. The opposing roller 15 is disposed on a lower side of the transfer drum 13 so as to oppose the transfer drum 13. Specifically, the opposing roller 15 is in contact with the transfer drum 13 by a predetermined pressure. Note that the direction in which the transport device 16 transports a sheet P is called "transport direction". In a corresponding one of the figures, the transport direction is indicated by the direction of arrow X.

The ejection units 14Y to 14K eject ink drops of corresponding colors, that is, yellow (Y), magenta (M), cyan (C), and black (K), onto an outer peripheral surface of the transfer drum 13 to form images on the outer peripheral surface of the transfer drum 13. The ejection units 14Y to 14K are disposed in this order toward a downstream side in a rotation direction of the transfer drum 13 (the direction E). The ejection units 14Y to 14K each have a length in an axial direction of the transfer drum 13. The ejection units 14Y to 14K each eject onto the outer peripheral surface of the transfer drum 13 ink drops from nozzles (not shown) by a publicly known method, such as a thermal method or a piezoelectric method.

In the image forming unit 12, the ejection units 14Y to 14K each eject ink drops of the corresponding color onto the outer peripheral surface of the transfer drum 13 to form images on the outer peripheral surface of the transfer drum 13. Further, in the image forming unit 12, the images that have been formed on the outer peripheral surface of the transfer drum 13 are transferred to a sheet P that passes between the transfer drum 13 and the opposing roller 15. Therefore, the images are formed on the upper surface of the sheet P. Note that the opposing roller 15 has a recessed portion 17 for reducing interference with grippers 76 (described later) of the transport device 16. When the grippers 76 pass between the transfer drum 13 and the opposing roller 15, the grippers 76 pass therebetween while being inserted in the recessed portion 17.

Heating Device 100

Figure 2:
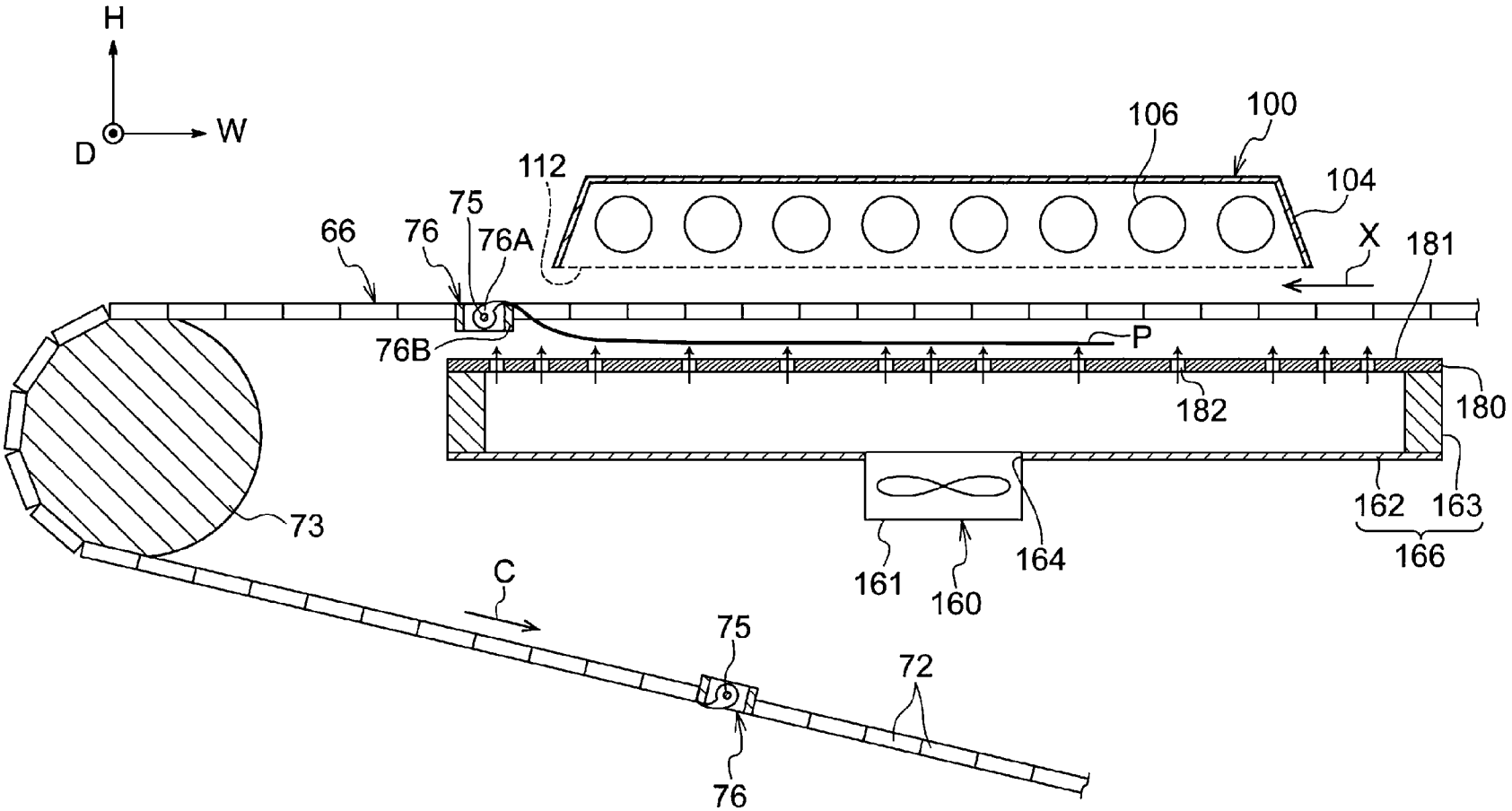
FIG. 2 is a schematic view of a structure of a heating device and a blowing device according to the first exemplary embodiment.

FIG. 2 is a schematic view of a structure of the heating device 100. The heating device 100 shown in FIGS. 1 and 2 is an example of a heating unit. As shown in FIG. 1, the heating device 100 is disposed on a downstream side with respect to the image forming unit 12 in the transport direction.

The heating device 100 is a device that in a non-contact manner heats the upper surface of a sheet P on which an image has been formed by the image forming unit 12. Specifically, the heating device 100 has the function of heating and thereby drying ink on the sheet P. More specifically, as shown in FIG. 2, the heating device 100 includes a reflecting plate 104, multiple heaters 106 (heating sources), and a wire net 112.

The reflecting plate 104 has the function of reflecting downward infrared rays from the heaters 106 (that is, toward the side of a sheet P that is transported by the transport device 16). The reflecting plate 104 has the shape of a box with an open lower side. The reflecting plate 104 is formed by using, for example, a metal plate, such as an aluminum plate.

Each heater 106 is a columnar infrared heater having a length in a width direction of a sheet P (hereunder may be called "sheet-width direction"). The heaters 106 are disposed side by side inside the reflecting plate 104 in the transport direction. Note that the sheet-width direction is an intersection direction that intersects the transport direction (specifically, an orthogonal direction). In a corresponding one of the figures, the sheet-width direction is indicated by a direction of a double-headed arrow Y.

The wire net 112 is disposed at the opening on the lower side of the reflecting plate 104. Therefore, the wire net 112 partitions the inside and the outside of the reflecting plate 104. The wire net 112 may prevent contact of the heaters 106 and a sheet P that is transported by the transport device 16.

Cooling Unit 90

As shown in FIG. 1, the cooling unit 90 is disposed on a downstream side with respect to the heating device 100 in the transport direction. The cooling unit 90 includes multiple cooling rollers 92 (for example, two cooling rollers 92) that are disposed side by side in the transport direction.

Each cooling roller 92 is a circular cylindrical roller that is made of, for example, a metal. Each cooling roller 92 has a structure that, by allowing a refrigerant, such as air or water, to flow therein, cools a sheet P by heat exchange with the refrigerant.

Transport Device 16

The transport device 16 shown in FIG. 1 is a device that transports a sheet P. Specifically, as shown in FIG. 1, the transport device 16 includes a transport mechanism 60, a reversing mechanism 80, and a blowing device 160.

Transport Mechanism 60

The transport mechanism 60 shown in FIG. 1 is a mechanism that transports a sheet P. Specifically, the transport mechanism 60 transports a sheet P accommodated in a corresponding one of the accommodation units 50 to the image forming unit 12 and causes the sheet P to pass through the image forming unit 12. The transport mechanism 60 transports the sheet P to the heating device 100 from the image forming unit 12 and causes the sheet P to pass the heating device 100. That is, the transport mechanism 60 has the function of transporting the sheet P on which an image has been formed in the heating device 100.

The transport mechanism 60 transports the sheet P with one of the surfaces of the sheet P facing upward in the image forming unit 12 and the heating device 100. The one of the surfaces is an image surface on which an image is formed in the image forming unit 12, and is a surface that is heated in the heating device 100.

Specifically, as shown in FIG. 1, the transport mechanism 60 includes sending rollers 62, multiple transport rollers 64, and a chain gripper 66. Note that the transport mechanism 60 is an example of a transport unit. The chain gripper 66, which is a structural element of the transport mechanism 60, may be understood as being an example of a transport unit.

Each sending roller 62 sends out a sheet P accommodated in a corresponding one of the accommodation units 50. The multiple transport rollers 64 transport the sheet P that has been sent out by the sending roller 62 to the chain gripper 66.

Figure 3:
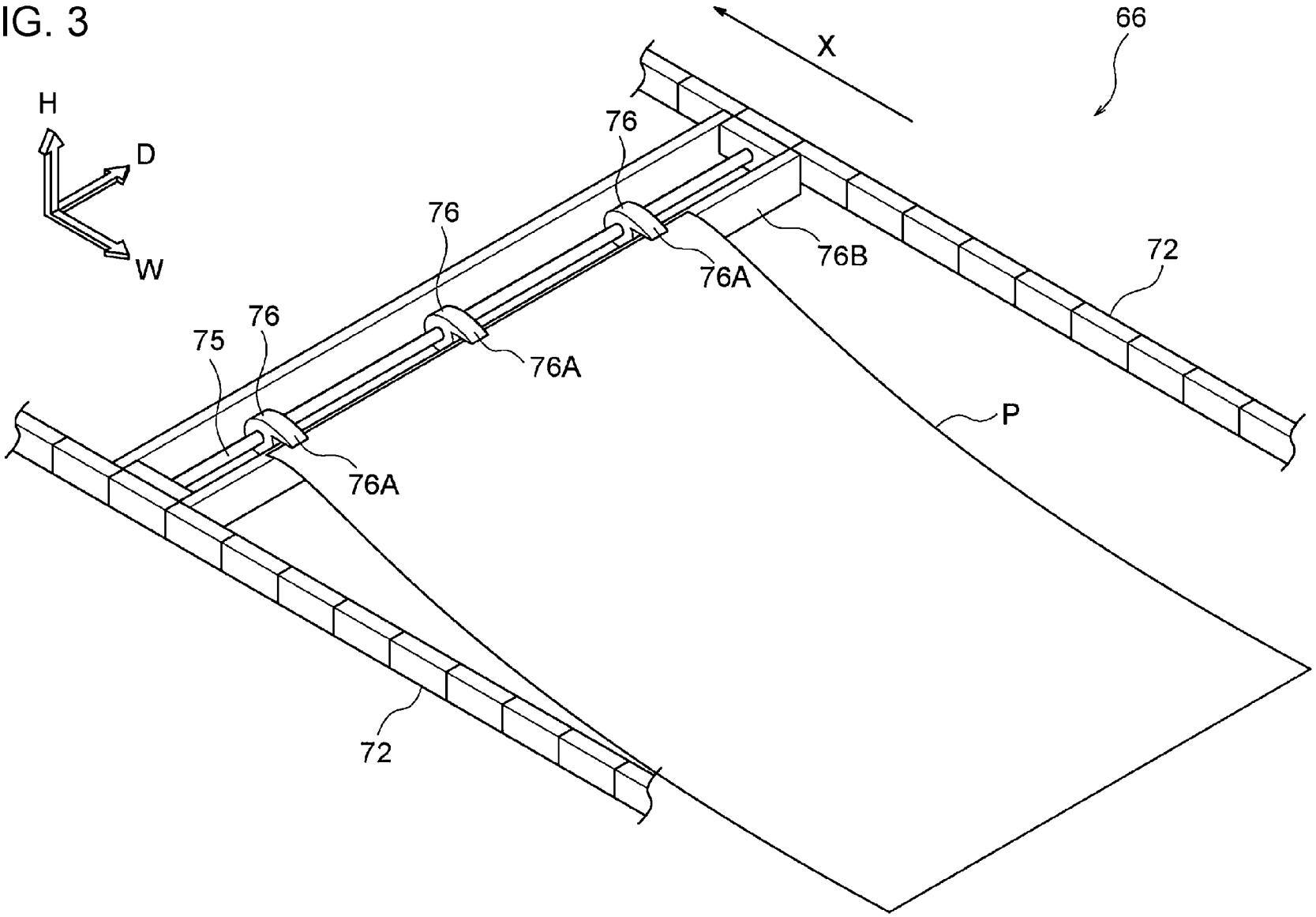
FIG. 3 is a perspective view of a structure of a chain gripper according to the first exemplary embodiment.

As shown in FIGS. 2 and 3, the chain gripper 66 is a transport unit that holds a front end portion (that is, a downstream portion in the transport direction) of a sheet P and transports the sheet P. Specifically, as shown in FIGS. 2 and 3, the chain gripper 66 includes a pair of chains 72 and the grippers 76 serving as holding members (gripping members).

As shown in FIG. 1, the pair of chains 72 have a ring shape. The pair of chains 72 are disposed apart from each other in the apparatus front-back direction (direction D in FIG. 1) (see FIG. 3). As shown in FIG. 1, the pair of chains 72 are wound around a pair of sprockets (not shown) and a pair of sprockets 73 and 74, the pair of sprockets (not shown) being disposed on one end side and the other end side in an axial direction with respect to the opposing roller 15 and the pair of sprockets 73 and 74 being disposed apart from each other in the apparatus front-back direction. By rotating either one of the pairs of sprockets, the chains 72 rotate in the direction of arrow C (see FIG. 1). Note that, in the corresponding figures, teeth that are provided on an outer periphery of each of the sprockets 73 and 74 are not shown.

As shown in FIG. 3, multiple mount members 75 on which the grippers 76 are mounted bridge a portion between the pair of chains 72 in the apparatus front-back direction. The mount members 75 are fixed to the pair of chains 72 at a predetermined interval in a circumferential direction (rotation direction) of the chains 72 (see FIGS. 1 and 2). Note that, in the corresponding figures, in order to simplify the illustration of the chains 72, the chains 72 are shown in the shape of a block.

As shown in FIG. 3, the grippers 76 are mounted on the multiple mount members 75 at a predetermined interval in the apparatus front-back direction. Each gripper 76 has the function of holding (gripping) a front end portion of a sheet P. Specifically, as shown in FIGS. 2 and 3, each gripper 76 has a claw 76A and a claw base 76B. Each gripper 76 has a structure that holds the sheet P by gripping the front end portion of the sheet P by the claw 76A and the claw base 76B. In each gripper 76, for example, the claw 76A is pushed against the claw base 76B by, for example, a spring, and the claw 76A is opened or closed with respect to the claw base 76B by the action of, for example, a cam. In this way, in the exemplary embodiment, each gripper 76 that is disposed on a downstream side in the transport direction with respect to the sheet P holds the front end portion of the sheet P from the downstream side in the transport direction of the sheet P.

As shown in FIG. 2, the chain gripper 66 transports a sheet P with one of the surfaces of the sheet P facing upward as a result of the chains 72 rotating in the direction of arrow C with a front end portion of the sheet P being held by the grippers 76. At this time, the chain gripper 66 transports the sheet P without holding a rear-end-side portion of the sheet P. That is, the sheet P is transported with the rear-end-side portion of the sheet P being in a free state without being restrained. Therefore, the sheet P passes the image forming unit 12 and the heating device 100 with one of the surfaces of the sheet P facing upward.

Note that the front end portion of the sheet P is an example of a downstream-side portion of a transport material in the transport direction. The rear-end-side portion of the sheet P is an example of a one-end-side portion of the transport material in the transport direction, and is an example of an upstream-side portion of the transport material in the transport direction. A portion of a transport path in which the sheet P is transported in the transport mechanism 60 is indicated by an alternate long and short dashed line in FIG. 1.

Blowing Device 160

The blowing device 160 shown in FIG. 2 is an example of a blowing unit. As shown in FIG. 2, in side view (that is, as viewed in the apparatus front-back direction), the blowing device 160 is disposed on an inner side (inner peripheral side) of the chains 72 and below the heating device 100. That is, in side view, a portion of each chain 72 is disposed between the heating device 100 and the blowing device 160. Therefore, a sheet P that is transported by the chain gripper 66 passes between the heating device 100 and the blowing device 160.

The blowing device 160 is a device that blows air against a lower surface of a sheet P that is transported by the chain gripper 66. Specifically, as shown in FIG. 2, the blowing device 160 includes a fan 161, a device body 166, and a blowing plate 180. The device body 166 has the shape of a box with an open upper side. Specifically, the device body 166 includes side walls 163 and a plate-shaped bottom wall 162, the side walls 163 being formed in the shape of a frame in plan view. An opening 164 is formed in a central portion of the bottom wall 162 in the transport direction and in a central portion in the apparatus front-back direction. The fan 161 is mounted with respect to the opening 164. The fan 161 is driven to thereby blow air into the device body 166 via the opening 164.

An example of the fan 161 is an axial-flow blower that blows air in an axial direction. Note that the fan 161 may be a centrifugal blower that blows air in a centrifugal direction, such as a multi-blade blower (for example, a sirocco fan), and is a blower that blows air. Note that the fan 161 is an example of a blower.

The blowing plate 180 is mounted on upper ends of the side walls 163 so as to cover the opening in an upper portion of the device body 166. Therefore, the device body 166 is hermetically sealed except the opening 164 and blowing holes 182 described below.

The blowing plate 180 has the shape of a plate in which the up-down direction is a thickness direction, and has an opposing surface 181 that opposes the heating device 100. The opposing surface 181 faces upward and opposes a lower surface of a sheet P that is transported between the heating device 100 and the blowing plate 180.

The blowing plate 180 is constituted by a metal plate. The blowing plate 180 also has the function of a reflecting plate that reflects upward (toward the side of a sheet P that is transported by the chain gripper 66) infrared rays from the heaters 106.

The blowing plate 180 has the multiple blowing holes 182 that extend through the blowing plate 180 in the up-down direction. That is, the multiple blowing holes 182 are provided in the opposing surface 181 and open with respect to a lower surface of a sheet P that is transported between the heating device 100 and the blowing plate 180.

Figure 4:
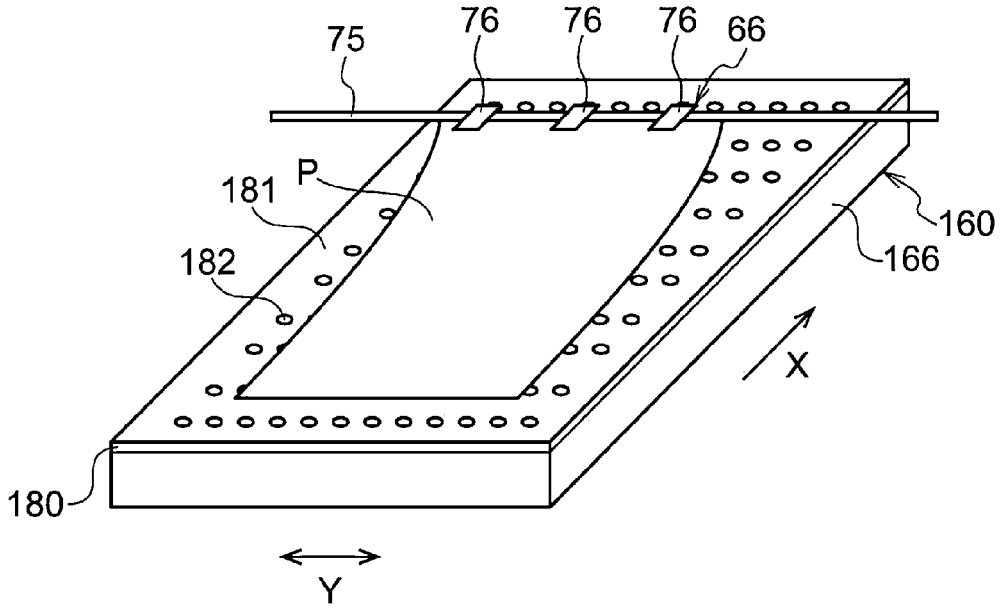
FIG. 4 is a perspective view of a structure of the blowing device according to the first exemplary embodiment.

As shown in FIG. 4, the blowing holes 182 are disposed two-dimensionally (in a matrix) in the transport direction and the sheet-width direction. Note that, in FIG. 4, the illustration of each portion of the chain gripper 66 and each portion of the blowing device 160 is simplified.

In the blowing device 160, the fan 161 is driven to blow air that has flowed into the device body 166 against a lower surface of a sheet P that is transported by the chain gripper 66 via the multiple blowing holes 182 (see FIG. 2). Therefore, a rear-end-side portion of the sheet P whose front end portion is held by the chain gripper 66 is raised from the opposing surface 181 of the blowing plate 180 and is brought out of contact with the opposing surface 181 of the blowing plate 180. That is, the sheet P is transported without being in contact with the opposing surface 181 of the blowing plate 180 by the chain gripper 66 and the blowing device 160.

Figure 5:
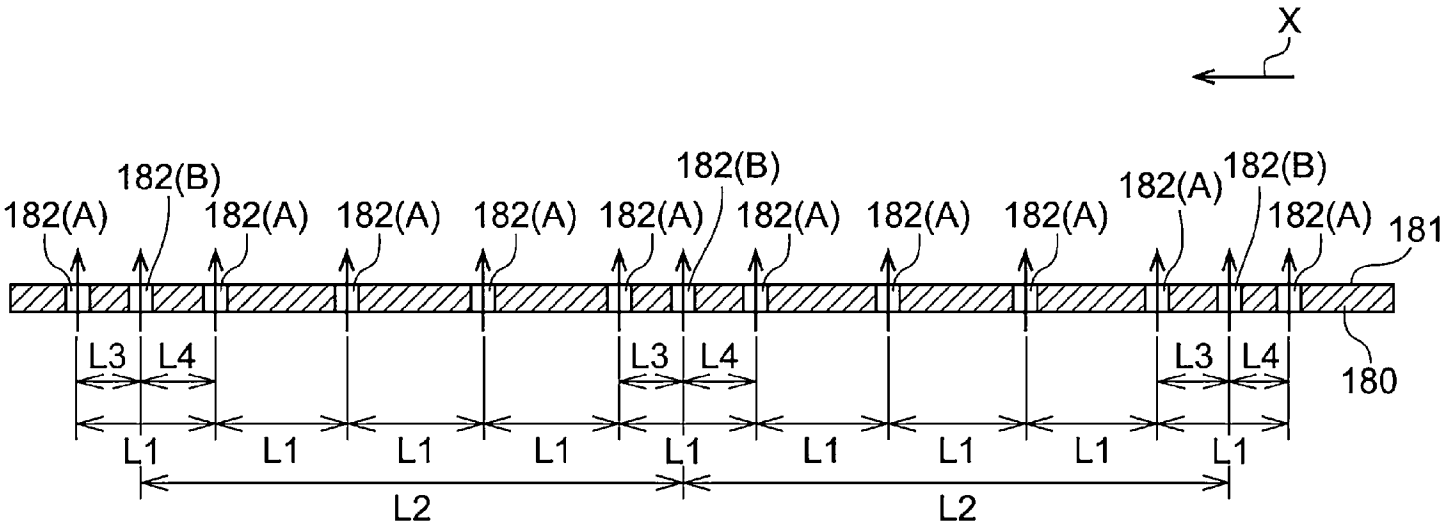
FIG. 5 is a sectional view of a structure of a blowing plate of the blowing device according to the first exemplary embodiment.
Figure 6A:
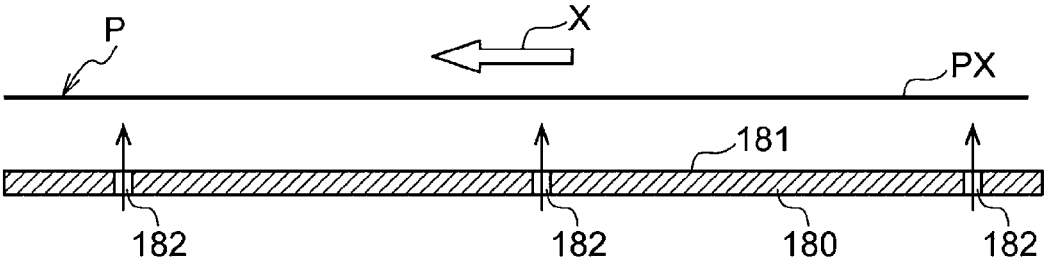
FIGS. 6A to 6D are each an explanatory view of the behavior of a rear-end-side portion of a sheet in a blowing device according to a comparative example.
Figure 6B:
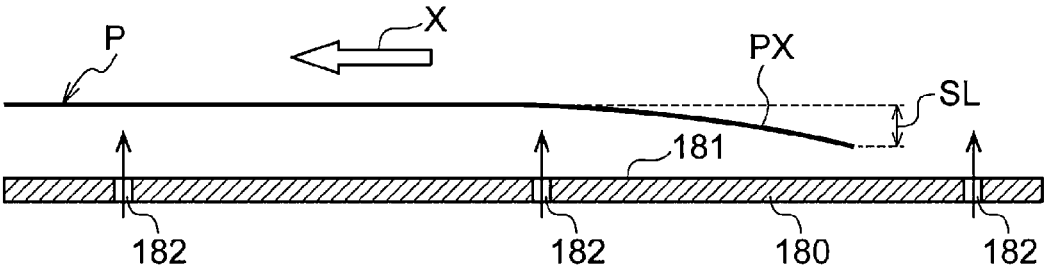
Figure 6C:
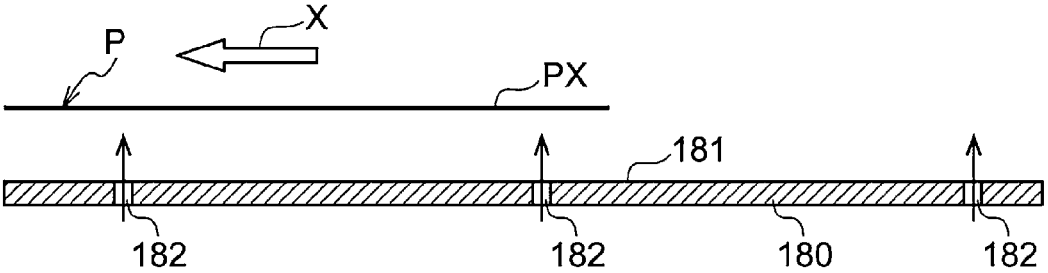
Figure 6D:
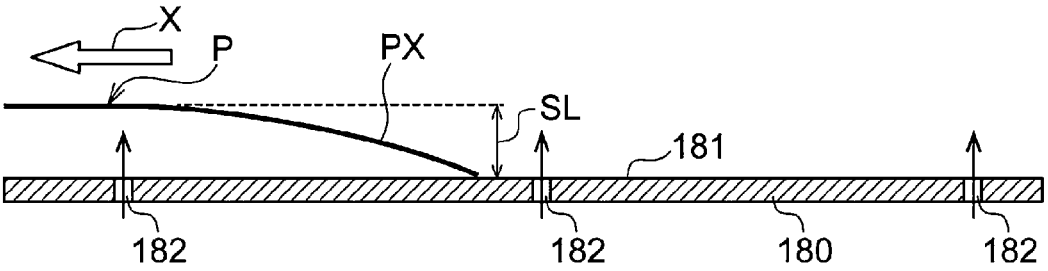

Here, as shown in FIG. 5, an arrangement interval of the multiple blowing holes 182 in the transport direction (direction X) is inconstant in the transport direction. That is, the arrangement interval of the multiple blowing holes 182 in the transport direction (direction X) is not constant.

Specifically, the multiple blowing holes 182 include first blowing holes 182(A) that are disposed at a predetermined first period L1 in the transport direction and second blowing holes 182(B) that are disposed at a second period L2 differing from the first period L1 in the transport direction. The second blowing holes 182(B) are disposed in an area in which the first blowing holes 182(A) are disposed. That is, at least some of the second blowing holes 182(B) are disposed between the first blowing holes 182(A). In the exemplary embodiment, the second period L2 is longer than the first period L1. The relationship between the second period L2 and the first period L1 is not an integral multiple or an integral submultiple.

In this way, since the first blowing holes 182(A) and the second blowing holes 182(B) are disposed, the multiple blowing holes 182 are disposed at arrangement intervals L3, L4, and L1. Although the arrangement interval L1 is constant, the arrangement intervals L3 and L4 vary. The arrangement intervals L3 and L4 are shorter than the arrangement interval L1. In this way, in the exemplary embodiment, the arrangement interval of the multiple blowing holes 182 in the transport direction (direction X) is inconstant in the transport direction. Note that the arrangement interval in the transport direction corresponds to a distance (pitch) between the centers of the blowing holes 182 in the transport direction. FIG. 5 does not show the device body 166 of the blowing device 160.

Reversing Mechanism 80

The reversing mechanism 80 shown in FIG. 1 is a mechanism that reverses the front and back of a sheet P whose image has been heated by the heating device 100. Specifically, as shown in FIG. 1, the reversing mechanism 80 includes multiple transport rollers 82 (for example, two transport rollers 82), a reversing device 84, and multiple transport rollers 86 (for example, seven transport rollers 86).

The multiple transport rollers 82 transport a sheet P that has been sent from the heating device 100 to the reversing device 84. The reversing device 84 reverses the front and the back of the sheet P. The multiple transport rollers 86 transport the sheet P whose front and back have been reversed by the reversing device 84 to the chain gripper 66. That is, the multiple transport rollers 86 each have the function of transferring the sheet P whose front and back have been reversed to the chain gripper 66.

In this way, the reversing mechanism 80 reverses the top and bottom of the sheet P that has passed a location between the heating device 100 and the opposing surface 181 and transfers the sheet P to the chain gripper 66 to thereby cause the chain gripper 66 to transport again the transferred sheet P with its surface having a heated and dried image formed thereon facing downward to the location between the heating device 100 and the opposing surface 181 via the image forming unit 12. Note that a portion of a transport path in which the sheet P is transported in the reversing mechanism 80 is indicated by an alternate long and short dashed line in FIG. 1.

Operation According to Exemplary Embodiment

In the exemplary embodiment, a sheet P that has been sent out from a corresponding one of the accommodation units 50 shown in FIG. 1 is transported by the multiple transport rollers 64 and is transferred to the chain gripper 66. The sheet P that has been transferred to the chain gripper 66 is transported to the image forming unit 12 with a front end portion of the sheet P being held by the chain gripper 66 and without a rear-end-side portion of the sheet P being held. On the other hand, in the image forming unit 12, the ejection units 14Y to 14K eject ink drops of the corresponding colors to the outer peripheral surface of the transfer drum 13 to form images on the outer peripheral surface of the transfer drum 13. The images that have been formed on the outer peripheral surface of the transfer drum 13 are transferred to the sheet P that is transported to the image forming unit 12, to thereby form an image. As shown in FIG. 2, the sheet P on which the image has been formed is transported by the chain gripper 66 with an image surface opposing the heaters 106 of the heating device 100, and the image is dried by being heated by the heating device 100.

When an image is to be formed on only one side of a sheet P, the sheet P whose image has been dried by the heating device 100 is discharged to the discharge unit 52 after being cooled by the cooling rollers 92 of the cooling unit 90.

When images are to be formed on both sides of a sheet P, the sheet P whose image on one side has been dried has its front and back reversed by the reversing mechanism 80 shown in FIG. 1, and then is transferred again to the chain gripper 66. The sheet P that has been transferred to the chain gripper 66 is transported to the image forming unit 12 with the image that has been already formed facing downward, and images are transferred to an upper surface of the sheet P from the transfer drum 13 to form an image. Similarly to the above, the sheet P whose image has been formed is heated and thus dried by the heating device 100, is then cooled by the cooling rollers 92 of the cooling unit 90, and is discharged to the discharge unit 52.

Here, in the exemplary embodiment, as described above, the arrangement interval of the multiple blowing holes 182 in the transport direction (direction X) is inconstant in the transport direction as shown in FIG. 5. That is, the arrangement interval of the multiple blowing holes 182 in the transport direction (direction X) is not constant.

For example, in a structure (hereunder referred to as "first structure") that has only blowing holes that are disposed at a constant interval in the transport direction, as shown in FIGS. 6A, 6B, 6C, and 6D, when a sheet P is transported in the transport direction (direction X), blowing air from the blowing holes 182 against a rear-end-side portion PX of the sheet P each time the rear-end-side portion PX passes a blowing hole 182 causes the rear-end-side portion PX to vibrate at a constant period. When this period and the natural frequency of the rear-end-side portion PX of the sheet P match, resonance occurs and amplitude SL is increased (amplitude SL in FIG. 6B<amplitude SL in FIG. 6D). Therefore, the rear-end-side portion PX of the sheet P repeatedly comes into contact with and separates from the opposing surface 181.

When the rear-end-side portion PX of the sheet P repeatedly comes into contact with and separates from the opposing surface 181, the sheet P may be torn or wrinkled. Since the opposing surface 181 is heated by the heating device 100, when images are to be formed on both sides of the sheet P, repeated contact and separation of the rear-end-side end portion PX of the sheet P with respect to the opposing surface 181 may cause image failure due to an image being melted and rubbing against the opposing surface 181. Note that, for example, a structure that has only the blowing holes 182(A) in the structure shown in FIG. 5 corresponds to the first structure. The rear-end-side portion PX of the sheet P refers to, for example, a range of one pitch of a blowing hole 182 from a rear end of the sheet P.

In contrast, in the exemplary embodiment, as described above, since the arrangement interval of the multiple blowing holes 182 in the transport direction (direction X) is inconstant in the transport direction as shown in FIG. 5, compared with the first structure, the tendency with which the period in which a sheet P is vibrated and the natural frequency of the rear-end-side portion PX of the sheet P match may be reduced and the rear-end-side portion PX of the sheet P may be suppressed from resonating. That is, according to the exemplary embodiment, compared with the first structure, the amplitude of the rear-end-side portion PX of the sheet P may be kept small.

Further, in the exemplary embodiment, the multiple blowing holes 182 include the first blowing holes 182(A) that are disposed at the predetermined first period L1 in the transport direction and the second blowing holes 182(B) that are disposed at the second period L2 differing from the first period L1 in the transport direction.

For example, in a structure (hereunder referred to as "second structure") in which first blowing holes 182(A) and second blowing holes 182(B) are disposed at a first period L1 (see FIG. 7), an interval L3 between the first blowing holes 182(A) and the corresponding second blowing holes 182(B) becomes constant.

In contrast, in the exemplary embodiment, since the first blowing holes 182(A) and the second blowing holes 182(B) are disposed at different periods, the interval L3 between the first blowing holes 182(A) and the corresponding second blowing holes 182(B) varies. Therefore, compared with the second structure, matching of the period in which a sheet P is vibrated and the natural frequency of the rear-end-side portion PX of the sheet P may occur less frequently and the rear-end-side portion PX of the sheet P may be suppressed from resonating.

As described above, according to the exemplary embodiment, since the rear-end-side portion PX of the sheet P may be suppressed from resonating, the rear-end-side portion PX may be suppressed from repeatedly coming into contact with and separating from the opposing surface 181. Therefore, even when images are to be formed on both sides of the sheet P, image failure caused by an image being melted and rubbing against the opposing surface 181 may be suppressed. Note that FIGS. 6A to 6D and FIG. 7 do not show the device body 166 of the blowing device 160.

Modifications of Arrangement of Blowing Holes 182

Figure 7:
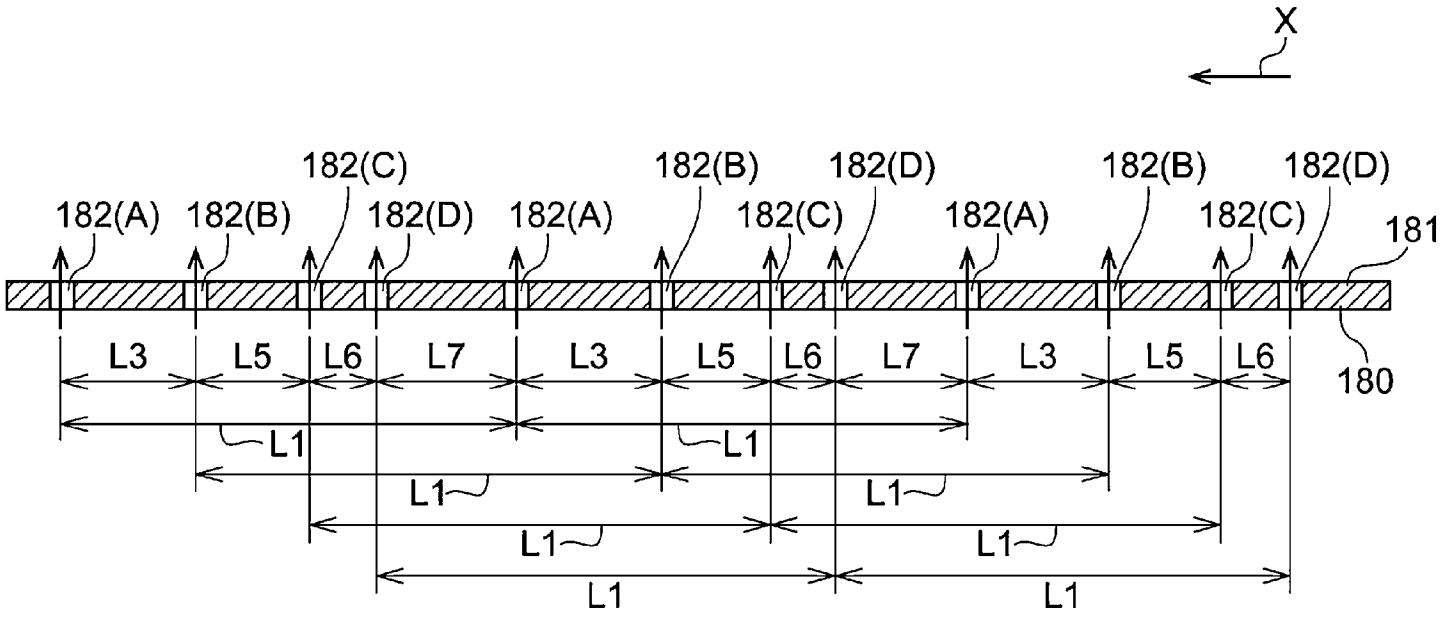
FIG. 7 is a sectional view of a structure of a blowing plate of a blowing device according to a modification.

In the exemplary embodiment, the multiple blowing holes 182 include the first blowing holes 182(A) that are disposed at the predetermined first period L1 in the transport direction and the second blowing holes 182(B) that are disposed at the second period L2 differing from the first period L1 in the transport direction. However, it is not limited thereto. For example, as shown in FIG. 7, a structure that has blowing holes 182(A), 182(B), 182(C), and 182(D) that are disposed at the same period (first period L1) and out of phase with each other may be used. Alternatively, the blowing holes 182 may be irregularly disposed in the transport direction, or the arrangement interval of the blowing holes 182 may be inconstant in the transport direction. Note that, in the structure shown in FIG. 7, the multiple blowing holes 182 are disposed at arrangement intervals L3, L5, L6, and L7. Although the arrangement intervals L3, L5, L6, and L7 are different intervals, they are each a constant interval.

Second Exemplary Embodiment

Image Forming Apparatus 200

Figure 8:
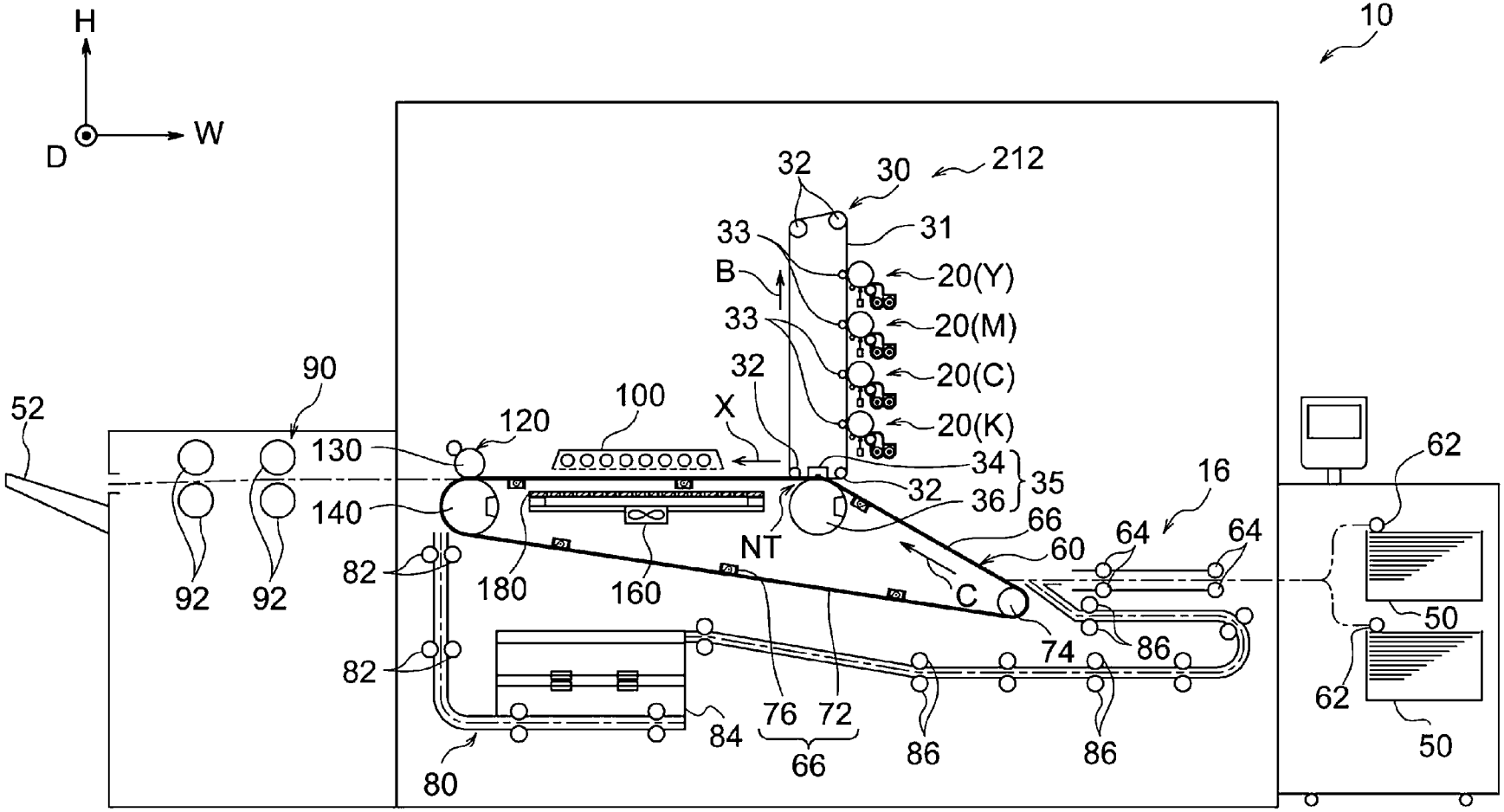
FIG. 8 is a schematic view of a structure of an image forming apparatus according to a second exemplary embodiment.

In the first exemplary embodiment, although the image forming apparatus 10 is an inkjet image forming apparatus that forms an image on a sheet P by using ink, an image forming apparatus is not limited thereto. An example of an image forming apparatus may be an electrophotographic image forming apparatus and is an apparatus that forms an image. In a second exemplary embodiment, an electrophotographic image forming apparatus 200 is described. FIG. 8 is a schematic view of a structure of the image forming apparatus 200 according to the second exemplary embodiment. Note that portions having the same functions as those of corresponding portions of the first exemplary embodiment are given the same reference numerals and are not described as appropriate.

The image forming apparatus 200 includes an image forming unit 212 instead of the image forming unit 12. The image forming apparatus 200 also includes a fixing unit 120 (an example of a fixing device). Note that the image forming apparatus 200 has the same structure as the image forming apparatus 10 in terms of a blowing device 160.

Image Forming Unit 212

The image forming unit 212 shown in FIG. 8 is an example of an image forming unit that forms an image on a recording medium. Specifically, the image forming unit 212 has the function of forming a toner image on a sheet P by an electrophotographic system. More specifically, as shown in FIG. 8, the image forming unit 212 includes toner-image forming units 20 that each form a toner image and a transfer device 30 that transfers to the sheet P the toner images formed by the toner-image forming units 20.

Toner-Image Forming Units 20

The toner-image forming units 20 are provided so as to form toner images according to color. The image forming apparatus 10 includes the toner-image forming units 20 for a total of four colors, that is, yellow (Y), magenta (M), cyan (C), and black (K). (Y), (M), (C), and (K) shown in FIG. 8 denote structural portions corresponding to the respective colors.

Figure 9:
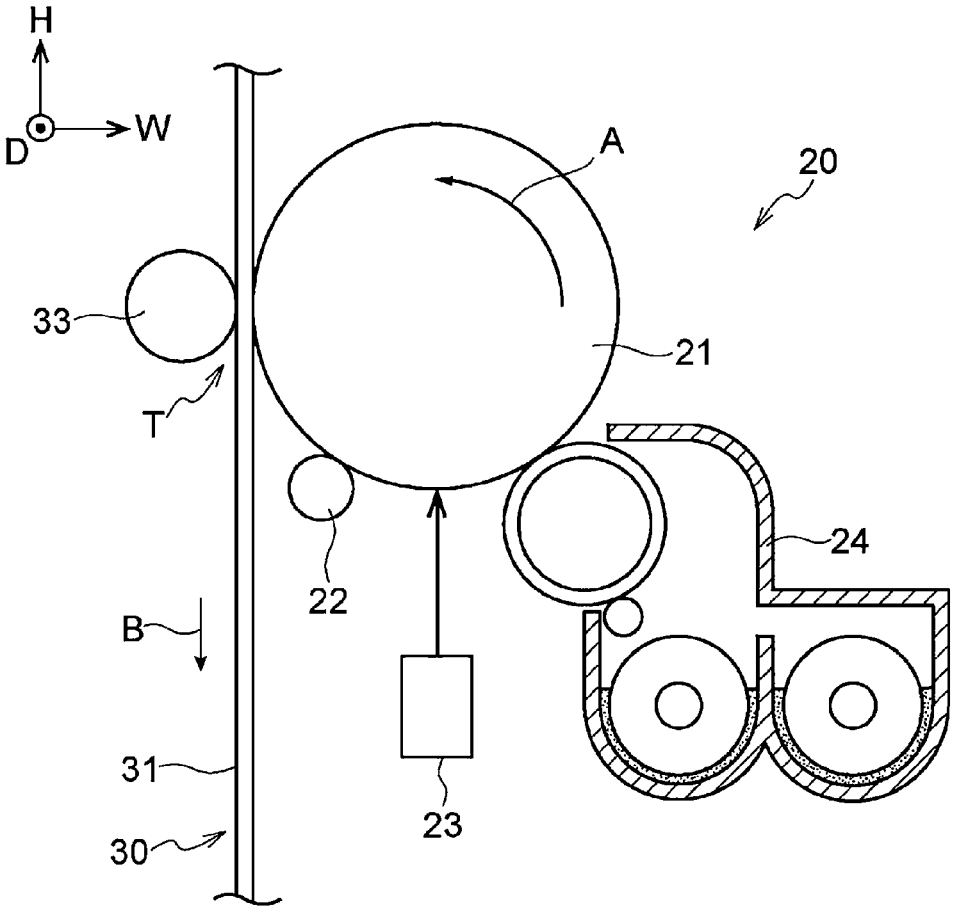
FIG. 9 is a schematic view of a structure of a toner-image forming unit according to the second exemplary embodiment.

The toner-image forming units 20 for the corresponding colors basically have the same structure except in the toner used. Specifically, as shown in FIG. 9, each toner-image forming unit 20 for the color corresponding thereto includes a photoconductor drum 21 (photoconductor) that rotates in the direction of arrow A in FIG. 9 and a charging unit 22 that charges the photoconductor drum 21. Each toner-image forming unit 20 for the color corresponding thereto also includes an exposure device 23 that exposes the photoconductor drum 21 charged by the charging unit 22 to form an electrostatic latent image on the photoconductor drum 21, and a developing device 24 that develops the electrostatic latent image formed on the photoconductor drum 21 by the exposure device 23 to form a toner image.

Transfer Device 30

The transfer device 30 shown in FIG. 8 has the function of, by allowing the toner images on the photoconductor drums 21 for the corresponding colors to be superposed upon an intermediate transfer body, first-transferring the toner images to the intermediate transfer body and second-transferring the superposed toner images to a sheet P. Specifically, as shown in FIG. 8, the transfer device 30 includes a transfer belt 31, serving as the intermediate transfer body, first-transfer rollers 33, and a transfer unit 35.

Each first-transfer roller 33 has the function of transferring the toner image formed on the photoconductor drum 21 corresponding thereto to the transfer belt 31 at a first-transfer position T (see FIG. 9) between the photoconductor drum 21 and the first-transfer roller 33.

As shown in FIG. 8, the transfer belt 31 is an endless belt, and has its orientation determined by being wound around multiple rollers 32. By rotationally driving at least one of the multiple rollers 32, the transfer belt 31 rotates in the direction of arrow B to transport the first-transferred images to a second-transfer position NT.

The transfer unit 35 has the function of transferring to a sheet P the toner images transferred to the transfer belt 31. Specifically, the transfer unit 35 includes a second-transfer unit 34 and an opposing roller 36.

The opposing roller 36 is disposed on a lower side of the transfer belt 31 so as to oppose the transfer belt 31. As shown in FIG. 8, the second-transfer unit 34 is disposed on an inner side of the transfer belt 31 so that the transfer belt 31 is disposed between the second-transfer unit 34 and the opposing roller 36. Specifically, the second-transfer unit 34 is constituted by a corotron. At the transfer unit 35, the toner images transferred to the transfer belt 31 are, by an electrostatic force generated by electric discharge at the second-transfer unit 34, transferred to a sheet P that passes the second-transfer position NT.

Fixing Unit 120

Figure 10:
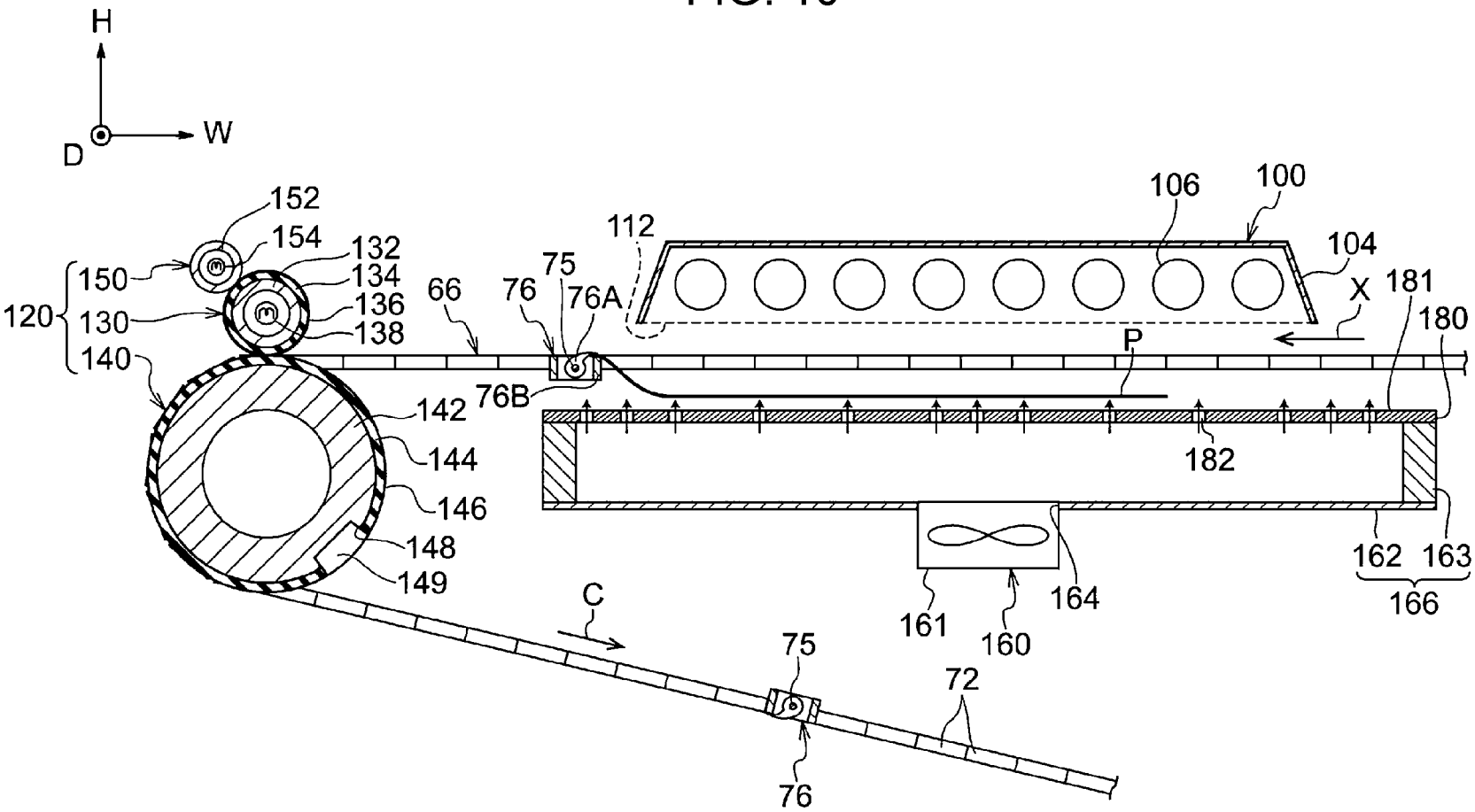
FIG. 10 is a schematic view of a structure of a fixing unit according to the second exemplary embodiment.

The fixing unit 120 shown in FIG. 10 is a fixing unit that fixes an image on a sheet P to the sheet P. Specifically, the fixing unit 120 has the function of fixing a toner image to the sheet P by coming into contact with the sheet P and heating and pressing the sheet P. In the exemplary embodiment, a heating device 100 preliminarily heats the sheet P and the fixing unit 120 fixes the toner image to the sheet P.

In the exemplary embodiment, although the description is made by using the fixing unit 120 that heats and presses a sheet, the fixing may be performed without heating, and if the purpose is to improve the surface nature of toner that is fused by the heating device 100 in the previous step, for example, to adjust gloss, the fixing may be performed only by pressing by a pressing unit.

As shown in FIG. 10, the fixing unit 120 is disposed on a downstream side of the heating device 100 in the transport direction of a sheet P. Specifically, the fixing unit 120 includes a heating roller 130, a pressing roller 140, and a driven roller 150.

Heating Roller 130

The heating roller 130 shown in FIG. 10 is disposed on a downstream side in the transport direction with respect to the heating device 100 and has the function of heating a sheet P by coming into contact with the sheet P. The heating roller 130 is disposed with the apparatus front-back direction being an axial direction so that the heating roller 130 comes into contact with an upper surface of the sheet P.

The heating roller 130 includes a circular cylindrical base 132, a rubber layer 134 that is formed around an outer periphery of the base 132, a release layer 136 that is formed around an outer periphery of the rubber layer 134, and a heater 138 (heating source) that is accommodated inside the base 132. The heater 138 is constituted by, for example, a single halogen lamp or multiple halogen lamps.

Driven Roller 150

The driven roller 150 shown in FIG. 10 is disposed with the apparatus front-back direction being an axial direction so that the driven roller 150 contacts an area of an outer peripheral surface of the heating roller 130 other than an area where the outer peripheral surface of the heating roller 130 comes into contact with a sheet P. The driven roller 150 includes a circular cylindrical base 152 and a heater 154 (heating source) that is accommodated inside the base 152. The driven roller 150 is rotated by being driven by the heating roller 130 and heats the heating roller 130.

Pressing Roller 140

The pressing roller 140 shown in FIG. 10 has the function of pressing a sheet P that is nipped by the pressing roller 140 and the heating roller 130. The pressing roller 140 is disposed on a lower side of the heating roller 130 with the apparatus front-back direction being an axial direction.

The pressing roller 140 includes a circular cylindrical base 142, a rubber layer 144 that is formed around an outer periphery of the base 142, and a release layer 146 that is formed around an outer periphery of the rubber layer 144.

The circumference of the pressing roller 140 is equal to the arrangement interval of grippers 76 at chains 72. As shown in FIG. 10, a recessed portion 148 that extends in the apparatus front-back direction is formed in an outer peripheral surface of the pressing roller 140.

When the grippers 76 that hold a front end portion of a sheet P pass between the pressing roller 140 and the heating roller 130, the grippers 76 enter the recessed portion 148.

Note that, in the fixing unit 120, the pressing roller 140 is rotationally driven by a driving unit (not shown), the heating roller 130 is rotated by being driven by the pressing roller 140, and the driven roller 150 is rotated by being driven by the heating roller 130.

Operation According to Exemplary Embodiment

In the exemplary embodiment, a sheet P that is sent out from an accommodation unit 50 shown in FIG. 8 is transported by multiple transport rollers 64 and is transferred to the chain gripper 66. The sheet P that has been transferred to the chain gripper 66 is, with a front end portion of the sheet P being held by the chain gripper 66 and without a rear-end-side portion thereof being held, transported to the second-transfer position NT to transfer toner images from the transfer belt 31 to an upper surface of the sheet P. As shown in FIG. 10, the sheet P to which the toner images have been transferred is transported by the chain gripper 66 with an image surface opposing heaters 106 of the heating device 100 to heat the toner images.

The sheet P whose toner images have been heated by the heating device 100 is further transported to the fixing unit 120 by the chain gripper 66 and is pressed and heated by being nipped by the heating roller 130 and the pressing roller 140. Therefore, the toner images are fixed to the sheet P. When an image is to be formed on only one side of the sheet P, the sheet P to which the toner images have been fixed is cooled by cooling rollers 92 of a cooling unit 90 shown in FIG. 8 and is then discharged to a discharge unit 52.

When images are to be formed on both sides of the sheet P, the sheet P to which the image has been fixed to one side thereof has its front and back reversed by a reversing mechanism 80 shown in FIG. 8 and is then transferred again to the chain gripper 66. The sheet P that has been transferred to the chain gripper 66 is, with the fixed toner images facing downward, transported to the second-transfer position NT, and toner images are transferred to an upper surface of the sheet P from the transfer belt 31.

Similarly to the above, the sheet P to which the toner images have been transferred is heated by the heating device 100 and is then pressed and heated by being nipped by the heating roller 130 and the pressing roller 140 to fix the toner images to the sheet P. The sheet P to which the toner images have been fixed is cooled by the cooling rollers 92 of the cooling unit 90 and is then discharged to the discharge unit 52.

Even in the exemplary embodiment, as shown in FIG. 5, the arrangement interval of the multiple blowing holes 182 in the transport direction (direction X) is inconstant in the transport direction. Therefore, compared with the first structure, the tendency with which the period in which a sheet P is vibrated and the natural frequency of the rear-end-side portion PX of the sheet P match may be reduced and the rear-end-side portion PX of the sheet P may be suppressed from resonating.

Modifications of Transport Mechanism 60

In the first and second exemplary embodiments above, the chain gripper 66 transports a sheet P with the grippers 76 holding a front end portion of the sheet P. However, the grippers 76 may hold at least a front-end-side portion of the sheet P. The front-end-side portion of the sheet P is a portion that is situated on a downstream side (front side) with respect to the center of the sheet P in the transport direction.

In the first and second exemplary embodiments above, the grippers 76 that are disposed on a downstream side with respect to a sheet P in the transport direction hold a front end portion of the sheet P from a downstream side of the sheet P in the transport direction. However, it is not limited thereto. The grippers 76 may hold a front-end-side portion of the sheet P from two end sides in the sheet-width direction with respect to the sheet P.

In the first and second exemplary embodiments, with a front end portion of a sheet P being held by the chain gripper 66 and without a rear-end-side portion thereof being held, the sheet P is transported between the heating device 100 and the blowing device 160. However, it is not limited thereto. For example, a structure in which a sheet P is transported between the heating device 100 and the blowing device 160 by a pair of transport rollers may be used. Even in such a structure, in the process of nipping and transporting the sheet P by the pair of transport rollers, the sheet P is transported with a front-end-side portion of the sheet P being held and without the rear-end-side portion thereof being held.

Further, in this structure, in the process of nipping and transporting the sheet P by the pair of transport rollers, the sheet P is transported with the rear-end-side portion of the sheet P being held and without the front-end-side portion thereof being held. In this case, the front-end-side portion of the sheet P is an example of a one-end-side portion of a sheet-like transport material in the transport direction. In this way, an example of the one-end-side portion of the sheet-like transport material in the transport direction may be not only the rear-end-side portion of the sheet P but also the front-end-side portion of the sheet P.

Modifications of Transport Material

In the first and second exemplary embodiments above, as an example of a sheet-like transport material, a sheet P is used. However, it is not limited thereto. Here, "transport material" in a "sheet-like transport material" refers to a material that is transported. "Sheet" in a "sheet-like transport material" refers to, for example, paper or a thin plate. Therefore, "sheet-like" refers to a shape of, for example, paper or a thin plate, without the property of the material being considered. Consequently, an example of a sheet-like transport material may be, for example, a heat-resistant resin film or a metal film, and is any sheet-like material that can be transported.

The present disclosure is not limited to the exemplary embodiments above, and various modifications, changes, or improvements are possible within a scope that does not depart from the spirit of the present disclosure. For example, a structure may be formed by combining multiple modifications described above as appropriate.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A transport device comprising:

a transport unit that transports a sheet-like transport material without holding a one-end-side portion of the transport material in a transport direction; and a blowing unit that blows air against a lower surface of the transport material that is transported by the transport unit via a plurality of blowing holes that open with respect to the lower surface, an arrangement interval of the plurality of blowing holes in the transport direction being inconstant in the transport direction, wherein the plurality of blowing holes include first blowing holes that are disposed at a predetermined first period in the transport direction, and second blowing holes that are disposed at a second period differing from the first period in the transport direction in an area in which the first blowing holes are disposed, and at least some of the second blowing holes are disposed between the first blowing holes.

2. The transport device according to claim 1, wherein the transport unit transports the transport material with a downstream-side portion of the transport material in the transport direction being held and without an upstream-side portion of the transport material in the transport direction being held, and wherein the blowing unit has an opposing surface that opposes the lower surface of the transport material, the opposing surface having the plurality of blowing holes, and the blowing unit blows air against the lower surface of the transport material and raises the upstream-side portion of the transport material in the transport direction from the opposing surface.

3. An image forming apparatus comprising:

an image forming unit that forms an image on a recording medium serving as a transport material;

a heating unit that in a non-contact manner heats an upper surface of the transport material on which the image has been formed by the image forming unit; and the transport device according to claim 1 in which the blowing unit blows air via the plurality of blowing holes provided in an opposing surface opposing the lower surface of the transport material, and raises the transport material from the opposing surface, the transport device reversing top and bottom of the transport material that has passed a location between the heating unit and the opposing surface to transport again the transport material to the location between the heating unit and the opposing surface.

* * * * *